US010156812B2

(12) United States Patent
Suenami

(10) Patent No.: US 10,156,812 B2
(45) Date of Patent: Dec. 18, 2018

(54) STIRRING CONVEYANCE MEMBER, DEVELOPING DEVICE INCLUDING THE SAME, AND IMAGE FORMING APPARATUS

(71) Applicant: KYOCERA Document Solutions Inc., Osaka (JP)

(72) Inventor: Koji Suenami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/835,860

(22) Filed: Dec. 8, 2017

(65) Prior Publication Data

US 2018/0164718 A1 Jun. 14, 2018

(30) Foreign Application Priority Data

Dec. 14, 2016 (JP) ..... 2016-242066
Dec. 14, 2016 (JP) ..... 2016-242081
Dec. 14, 2016 (JP) ..... 2016-242083

(51) Int. Cl.
*G03G 15/08* (2006.01)
*G03G 15/09* (2006.01)

(52) U.S. Cl.
CPC ..... *G03G 15/0893* (2013.01); *G03G 15/0877* (2013.01); *G03G 15/0921* (2013.01); *G03G 2215/083* (2013.01)

(58) Field of Classification Search
USPC ..... 399/119, 120, 252–256, 258, 259, 262, 399/263
See application file for complete search history.

(56) References Cited

U.S. PATENT DOCUMENTS 8,090,300 B2 * 1/2012 Suenami ..... G03G 15/0877 399/254
8,781,371 B2 * 7/2014 Watanabe ..... G03G 15/0877 366/321
2008/0025763 A1 1/2008 Suenami
2012/0201573 A1 8/2012 Watanabe et al.

FOREIGN PATENT DOCUMENTS

JP 2008-033109 A 2/2008
JP 2012163731 A 8/2012

* cited by examiner

*Primary Examiner* — Hoan Tran
(74) *Attorney, Agent, or Firm* — Studebaker & Brackett PC

(57) ABSTRACT

A stirring conveyance member includes a rotary shaft, a first spiral blade, and a second spiral blade. The first spiral blade has first cutouts each provided in a specific region adjacent to and upstream of a point of intersection with the second spiral blade in the conveyance direction of the powder by the first spiral blade. The second spiral blade has second cutouts each provided in a specific region adjacent to and upstream of a point of intersection with the first spiral blade in a conveyance direction of the powder by the second spiral blade. A radial height of the first spiral blade in portions where the first cutouts are provided is lower than a radial height of the second spiral blade in portions where the second cutouts are not provided.

20 Claims, 7 Drawing Sheets

STIRRING CONVEYANCE MEMBER, DEVELOPING DEVICE INCLUDING THE SAME, AND IMAGE FORMING APPARATUS

INCORPORATION BY REFERENCE

The present application claims priority under 35 U.S.C. § 119 to Japanese Patent Application No. 2016-242081, filed on Dec. 14, 2016, Japanese Patent Application No. 2016-242083, filed on Dec. 14, 2016, and Japanese Patent Application No. 2016-242066, filed on Dec. 14, 2016. The contents of these applications are incorporated herein by reference in their entirety.

BACKGROUND

The present disclosure relates to a stirring conveyance member, a developing device, and an image forming apparatus. The stirring conveyance member conveys a powder such as a developer while stirring the powder. The developing device includes the stirring conveyance member. The developing device is installed in the image forming apparatus.

In an image forming apparatus, a latent image is formed on a surface of an image bearing member constituted by a photosensitive member or the like, and the latent image is visualized as a toner image through development by a developing device. Developing methods include a two-component developing method using a two-component developer. A developing device employing the two-component developing method includes a developer container, a development roller, and a stirring conveyance member. The developer container accommodates a developer including a carrier and a toner. The development roller supplies the developer to the image bearing member. The stirring conveyance member conveys and supplies the developer from the developer container to the development roller while stirring the developer.

In the two-component developing method, image defects such as scattering of the toner and fogging may occur when the toner is insufficiently charged. Therefore, it is necessary to charge the toner to a specific level by sufficiently mixing the toner and the carrier through stirring.

Under the above circumstances, a powder stirring conveyance member includes a shaft member and a sub-conveyance part. Along with rotation of the shaft member, a main conveyance blade conveys a powder in a first direction that is an axial direction. Along with rotation of the main conveyance blade and the shaft member, the sub-conveyance part generates a conveying effect by which some of the powder is conveyed in a second direction that is another axial direction. The sub-conveyance part is a sub-conveyance blade, for example. The sub-conveyance blade has a smaller diameter than the main conveyance blade, and is wound in a direction opposite (in a phase opposite) to the main conveyance blade.

Further, another stirring conveyance member includes a rotary shaft, a first spiral blade, and a second spiral blade. The first spiral blade is formed on the outer circumferential surface of the rotary shaft. The first spiral blade conveys a powder in an axial direction through rotation of the rotary shaft. The second spiral blade is formed on the outer circumferential surface of the rotary shaft such that a region in which the first spiral blade is formed overlaps with a region in which the second spiral blade is formed. The second spiral blade is in a phase opposite to the first spiral blade. The second spiral blade has a lower height in a radial direction than the first spiral blade. The first spiral blade and the second spiral blade each have a trapezoidal cross section in a plane transverse to the lengthwise direction of the spiral blade. In each turn of the first spiral blade around the rotary shaft, the first spiral blade has a plurality of first expanded parts each having a larger base of the trapezoidal cross section than the other parts. In each turn of the second spiral blade around the rotary shaft, the second spiral blade has a plurality of second expanded parts each having a larger base of the trapezoidal cross section than the other parts. In each turn around the rotary shaft, the base of the trapezoidal cross section is expanded in each of the plurality of first expanded parts and the plurality of second expanded parts than in the other parts. In the stirring conveyance member, the first spiral blade and the second spiral blade intersect each other in at least one of the first expanded parts in each turn around the rotary shaft.

According to the above configuration, the second spiral blade (the sub-conveyance blade) generates conveying force in a direction opposite to a conveyance direction of the developer by the first spiral blade (the main conveyance blade), and as a result, a convective flow is generated in a portion of the developer being conveyed. Therefore, a stirring effect is promoted with almost no inhibition of a conveying effect of the first spiral blade (the main conveyance blade).

SUMMARY

A stirring conveyance member of the present disclosure includes a rotary shaft, a first spiral blade, and a second spiral blade. The rotary shaft is supported to be rotatable within a powder container. The first spiral blade is provided on an outer circumferential surface of the rotary shaft. The first spiral blade conveys a powder in an axial direction through rotation of the rotary shaft. The second spiral blade is provided on the outer circumferential surface of the rotary shaft such that, in the axial direction, a region in which the first spiral blade is provided overlaps with a region in which the second spiral blade is provided. The second spiral blade is in a phase opposite to the first spiral blade, and has a lower radial height than the first spiral blade. The first spiral blade intersects the second spiral blade at at least one point in each turn around the rotary shaft. The first spiral blade has first cutouts each provided in a specific region adjacent to and upstream of a point of intersection with the second spiral blade in the conveyance direction of the powder by the first spiral blade. The second spiral blade has second cutouts each provided in a specific region adjacent to and upstream of a point of intersection with the first spiral blade in a conveyance direction of the powder by the second spiral blade. A radial height of the first spiral blade in portions where the first cutouts are provided is lower than a radial height of the second spiral blade in portions where the second cutouts are not provided.

A stirring conveyance member of the present disclosure includes a rotary shaft, a first spiral blade, and a second spiral blade. The rotary shaft is supported to be rotatable within a powder container. The first spiral blade is provided on an outer circumferential surface of the rotary shaft. The first spiral blade conveys a powder in an axial direction through rotation of the rotary shaft. The second spiral blade is provided on the outer circumferential surface of the rotary shaft such that, in the axial direction, a region in which the first spiral blade is provided overlaps with a region in which the second spiral blade is provided. The second spiral blade is in a phase opposite to the first spiral blade, and has a lower radial height than the first spiral blade. The first spiral blade intersects the second spiral blade at at least one point in each turn around the rotary shaft. The first spiral blade has cutouts each formed in a specific region adjacent to and upstream of a point of intersection with the second spiral blade in the conveyance direction of the powder by the first spiral blade. A radial height of the first spiral blade in portions where the cutouts are provided is lower than a radial height of the second spiral blade.

A stirring conveyance member of the present disclosure includes a rotary shaft, a first spiral blade, and a second spiral blade. The rotary shaft is supported to be rotatable within a powder container. The first spiral blade is provided on an outer circumferential surface of the rotary shaft. The first spiral blade conveys a powder in an axial direction through rotation of the rotary shaft. The second spiral blade is provided on the outer circumferential surface of the rotary shaft such that, in the axial direction, a region in which the first spiral blade is provided overlaps with a region in which the second spiral blade is provided. The second spiral blade is in a phase opposite to the first spiral blade, and has a lower radial height than the first spiral blade. The first spiral blade intersects the second spiral blade at at least one point in each turn around the rotary shaft. The second spiral blade has cutouts each formed in a specific region adjacent to and upstream of a point of intersection with the first spiral blade in a conveyance direction of the powder by the second spiral blade.

DETAILED DESCRIPTION

The following describes embodiments of the present disclosure with reference to the drawings.

[First Embodiment]

Figure 1:
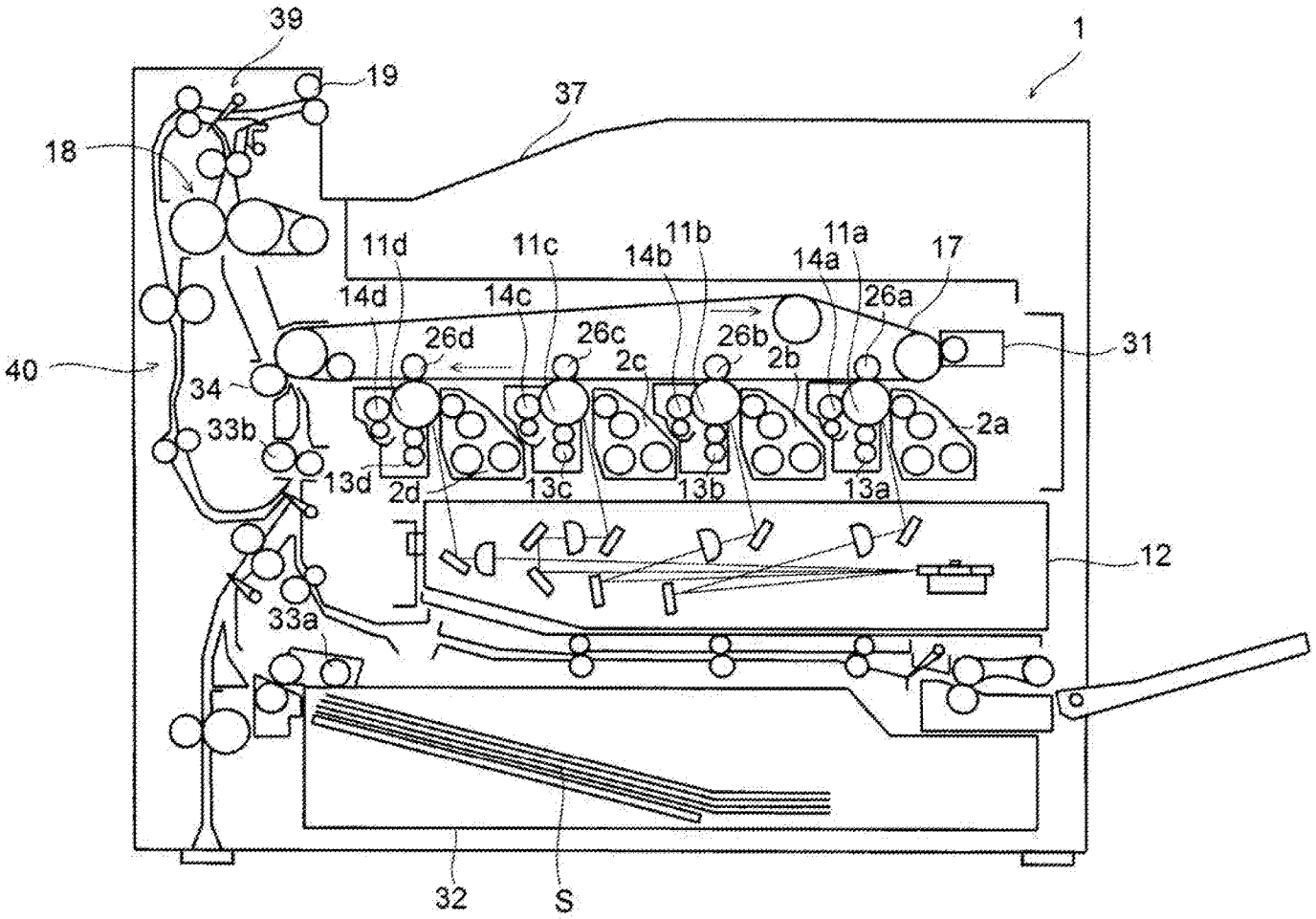
FIG. 1 is a schematic view illustrating an overall configuration of an image forming apparatus 1 in which developing devices 2*a* to 2*d* of the present disclosure are installed.

FIG. 1 is a schematic cross-sectional view of an image forming apparatus 1 of the present disclosure. Developing devices 2*a* to 2*d* are installed in the image forming apparatus 1. The image forming apparatus 1 is a tandem-type color printer. Photosensitive drums 11*a*, 11*b*, 11*c*, and 11*d* are provided within the image forming apparatus 1. The photosensitive drums 11*a*, 11*b*, 11*c*, and 11*d* hear visible images (toner images) in respective colors. The photosensitive drums 11*a*, 11*b*, 11*c*, and 11*d* respectively form the images in the respective colors of cyan, magenta, yellow, and black in order through charging, light exposure, development, and transfer. Further, an intermediate transfer belt 17 is provided within the image forming apparatus 1. The intermediate transfer belt 17 circulates in the clockwise direction in FIG. 1. The intermediate transfer belt 17 is adjacent to respective image forming sections including the photosensitive drums 11*a* to 11*d*.

When image data is input from a host device such as a personal computer, first, chargers 13*a* to 13*d* charge surfaces of the photosensitive drums 11*a* to 11*d* uniformly. Next, a light exposure device 12 irradiates the surfaces of the photosensitive drums 11*a* to 11*d* with light in accordance with the image data to form electrostatic latent images corresponding to the image data on the surfaces of the photosensitive drums. The developing devices 2*a* to 2*d* are charged with specific amounts of two-component developers (hereinafter may be simply referred to as developers) supplied from toner containers (not illustrated). The two-component developers include toners of the respective colors of cyan, magenta, yellow, and black. The developing devices 2*a* to 2*d* supply the toners included in the developers to the surfaces of the photosensitive drums 11*a* to 11*d*, thus causing the toners to adhere to the surfaces by electrostatic force. The above results in formation of the toner images corresponding to the electrostatic latent images formed through light exposure by the light exposure device 12.

Then, the toner images in the respective colors formed on the photosensitive drums 11*a* to 11*d* are primarily transferred onto the intermediate transfer belt 17. Specifically, an electric field is formed between the photosensitive drums 11*a* to 11*d* and primary transfer rollers 26*a* to 26*d* through application of an electric field to the primary transfer rollers 26*a* to 26*d* with specific transfer voltage. Through the above, the toner images in the respective colors of cyan, magenta, yellow, and black on the photosensitive drums 11*a* to 11*d* are primarily transferred onto the intermediate transfer belt 17. Thereafter, the toners and the like left on the surfaces of the photosensitive drums 11.*a* to 11*d* after the primary transfer are removed by cleaning devices 14*a* to 14*d*.

Transfer paper S is accommodated within a paper feed cassette 32 located in a lower part within the image forming apparatus 1. The toner images are transferred onto the transfer paper S. The transfer paper S is conveyed via a paper feed roller 33*a* and a registration roller pair 33*b* to a nip part (a secondary transfer nip part) between the intermediate transfer belt 17 and a secondary transfer roller 34 with a specific timing. The secondary transfer roller 34 is located adjacent to the intermediate transfer belt 17. After secondary transfer of the toner images onto the transfer paper 5, the transfer paper S is conveyed to a fixing section 18. The toners and the like left on a surface of the intermediate transfer belt 17 after the secondary transfer are removed by a belt cleaning device 31.

Heat and pressure are applied to the transfer paper S conveyed to the fixing section 18, thereby fixing the toner images on a surface of the transfer paper 5, thus forming a specific full-color image. The transfer paper S on which the full-color image has been formed is directly ejected to an exit tray 37 by an ejection roller pair 19. Alternatively, the transfer paper S on which the full-color image has been formed is diverged to an inversion conveyance path 40 by a diverging section 39. After the image has been formed on both sides of the transfer paper 5, the transfer paper S is ejected to the exit tray 37 by the ejection roller pair 19.

Figure 2:
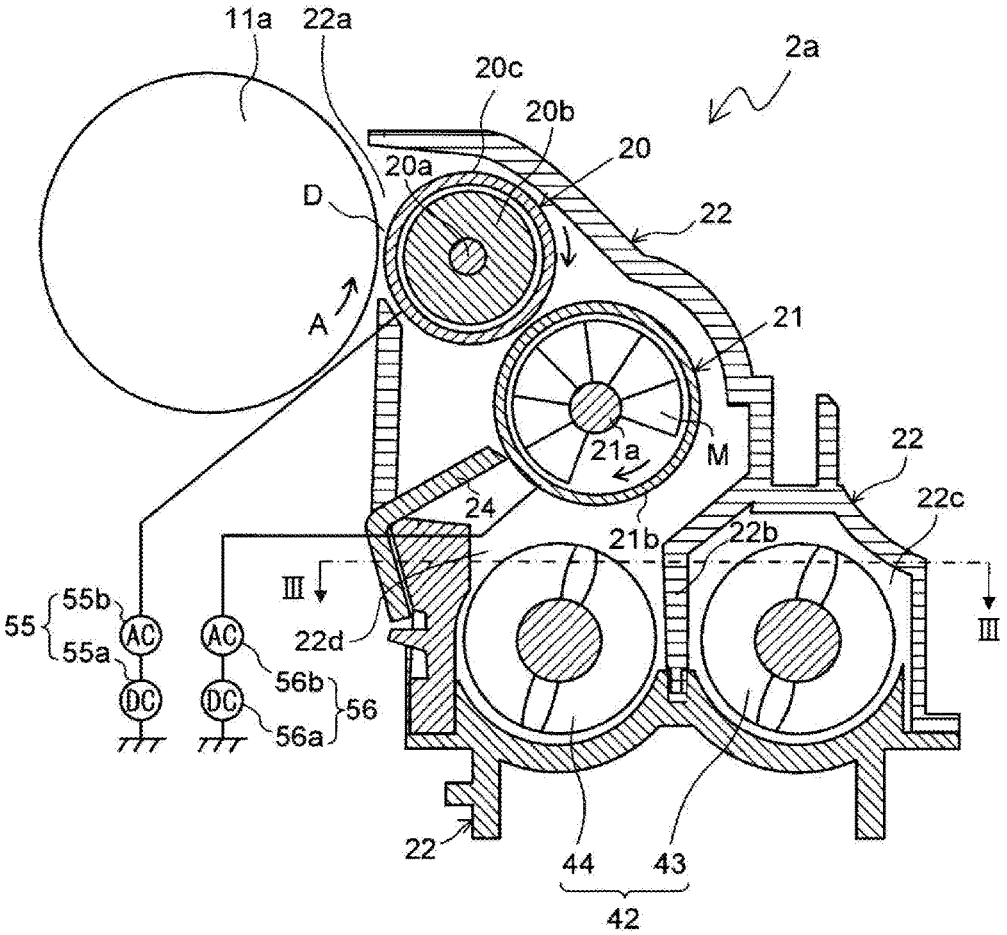
FIG. 2 is a cross-sectional side view of the developing device 2*a* including a first spiral 43 and a second spiral 44 as a stirring conveyance member of the present disclosure.

FIG. 2 is a cross-sectional side view illustrating a configuration of the developing device 2*a* of the present disclosure. Note that although the following describes the configuration and operation of the developing device 2*a* corresponding to the photosensitive drum 11*a* illustrated in FIG. 1, configurations and operation of the developing devices 2*b* to 2*d* are the same as those of the developing device 2*a*, and explanation of which will be omitted.

As illustrated in FIG. 2, the developing device 2*a* includes a development roller 20, a magnetic roller (a developer bearing member) 21, a regulation blade 24, a stirring conveyance member 42, a developer container (a powder container) 22, and the like.

The developer container 22 forms an outer frame of the developing device 2*a*. A lower part of the inside of the developer container 22 is partitioned into a first conveyance chamber 22*c* and a second conveyance chamber 22*d* by a partition 22*b*. A developer including a carrier and a toner is accommodated in the first conveyance chamber 22*c* and the second conveyance chamber 22*d*. Also, the stirring conveyance member 42, the magnetic roller 21, and the development roller 20 are supported by the developer container 22 so as to be rotatable. Further, the developer container 22 has an opening 22*a*. The development roller 20 is exposed toward the photosensitive drum 11*a* via the opening 22*a*.

The development roller 20 is located on the right of the photosensitive drum 11*a* with a specific distance therebetween so as to be opposite to the photosensitive drum 11*a*. The development roller 20 and the photosensitive drum 11*a* are spaced apart from each other by the specific distance. Further, the development roller 20 forms a development area D for supplying the toner to the photosensitive drum 11*a*. The development area D is formed at a position where the development roller 20 and the photosensitive drum 11 are close to each other. The magnetic roller 21 is located to the lower right of the development roller 20 so as to be opposite to the development roller 20. The magnetic roller 21 and the development roller 20 are spaced apart from each other by a specific distance. The toner is supplied from the magnetic roller 21 to the development roller 20 at a position where the magnetic roller 21 and the development roller 20 are close to each other. The stirring conveyance member 42 is located substantially below the magnetic roller 21. Also, the regulation blade 24 is fixedly supported by the developer container 22 so as to be located to the lower left of the magnetic roller 21.

The stirring conveyance member 42 includes two spirals: a first spiral (a first stirring conveyance member) 43 and a second spiral (a second stirring conveyance member) 44. The second spiral 44 is located below the magnetic roller 21 within the second conveyance chamber 22*d*. The first spiral 43 is located within the first conveyance chamber 22*c* so as to be next to the right side of the second spiral 44.

The first and second spirals 43 and 44 stir the developer to charge the toner in the developer to a specific electric potential. Through the above, the toner is borne by the carrier. Further, communication areas (not illustrated) are provided at respective opposite ends in a lengthwise direction (a direction perpendicular to the plane of FIG. 2) of the partition 22*b* separating the first conveyance chamber 22*c* and the second conveyance chamber 22*d*. When the first and second spirals 43 and 44 rotate, the charged developer circulates through the first conveyance chamber 22*c* and the second conveyance chamber 22*d* via the communication areas. Then, the developer is supplied from the second spiral 44 to the magnetic roller 21.

The magnetic roller 21 includes a roller shaft 21*a*, a magnetic pole member M, and a non-magnetic sleeve 21*h* formed from a non-magnetic material. The magnetic roller 21 bears the developer supplied from the stirring conveyance member 42, and supplies only the toner in the developer to the development roller 20. The magnetic pole member M is formed from a plurality of magnets. Each magnet has a fan-shaped cross section. The outer circumference of the magnetic pole member M is formed from outer arcs (outer arcs of the fan-shaped cross sections) of the plurality of magnets. Specifically, the outer arcs of magnets having opposite polarities are arranged alternately along the outer circumference of the magnetic pole member M. Inner arcs (inner arcs of the fan-shaped cross sections) of the plurality of magnets are fixed to the roller shaft 21*a* by bonding or the like. Within the non-magnetic sleeve 21*b*, the roller shaft 21*a* is supported by the developer container 22 so as to be non-rotatable, such that the magnetic pole member M and the non-magnetic sleeve 21*b* are spaced apart from each other by a specific distance. The non-magnetic sleeve 21*b* is driven by a driving mechanism including an unillustrated motor and an unillustrated gear to rotate in the same direction (the clockwise direction in FIG. 2) as the development roller 20. Also, a bias 56 is applied to the non-magnetic sleeve 21*b*. The bias 56 is generated by superimposing an alternating current voltage 56*b* on a direct current voltage 56*a*. A magnetic brush is formed on a surface of the non-magnetic sleeve 21*b* from the charged developer by magnetic force of the magnetic pole member M. The magnetic brush is borne on the surface of the non-magnetic sleeve 21*b*. The magnetic brush is adjusted to have a specific height by the regulation blade 24.

As the non-magnetic sleeve 21*b* rotates, the magnetic brush is brought into contact with the development roller 20. At this time, only the toner is supplied from the magnetic brush to the development roller 20 due to the bias 56 applied to the non-magnetic sleeve 21*b*.

The development roller 20 includes a fixed shaft 20*a*, a magnetic pole member 20*b*, a development sleeve 20*c*, and the like. The magnetic pole member 20*b* is formed from a magnet. The development sleeve 20*c* is formed from a non-magnetic metallic material and has a hollow cylindrical shape.

The fixed shaft 20*a* is supported by the developer container 22 so as to be non-rotatable. The development sleeve 20*c* is held by the fixed shaft 20*a* so as to be rotatable. Also, the magnetic pole member 20*b* is fixed to the fixed shaft 20*a* by bonding or the like. The development sleeve 20*c* is located opposite to the magnetic roller 21. The development sleeve 20*c* and the magnetic roller 21 are spaced apart from each other by a specific distance. The development sleeve 20*c* is driven by a driving mechanism including an unillustrated motor and an unillustrated gear to rotate in a direction (the clockwise direction) indicated by an arrow in FIG. 2. Also, a development bias 55 is applied to the development sleeve 20*c*. The development bias 55 is generated by superimposing an alternating current voltage 55*b* on a direct current voltage 55*a*.

When the development sleeve 20*c* to which the development bias 55 has been applied rotates in the clockwise direction in FIG. 2, the toner borne on a surface of the development sleeve 20*c* is detached in the development area D and flies toward the photosensitive drum 11*a*. This is due to a difference in electric potential between the development bias 55 and portions of the photosensitive drum 11 exposed to light. The detached toner adheres to the portions of the photosensitive drum 11*a* exposed to light in order along with rotation of the photosensitive drum 11*a* in a direction (the counterclockwise direction) indicated by an arrow A. As a result, an electrostatic latent image formed on the photosensitive drum 11*a* is developed.

Figure 3:
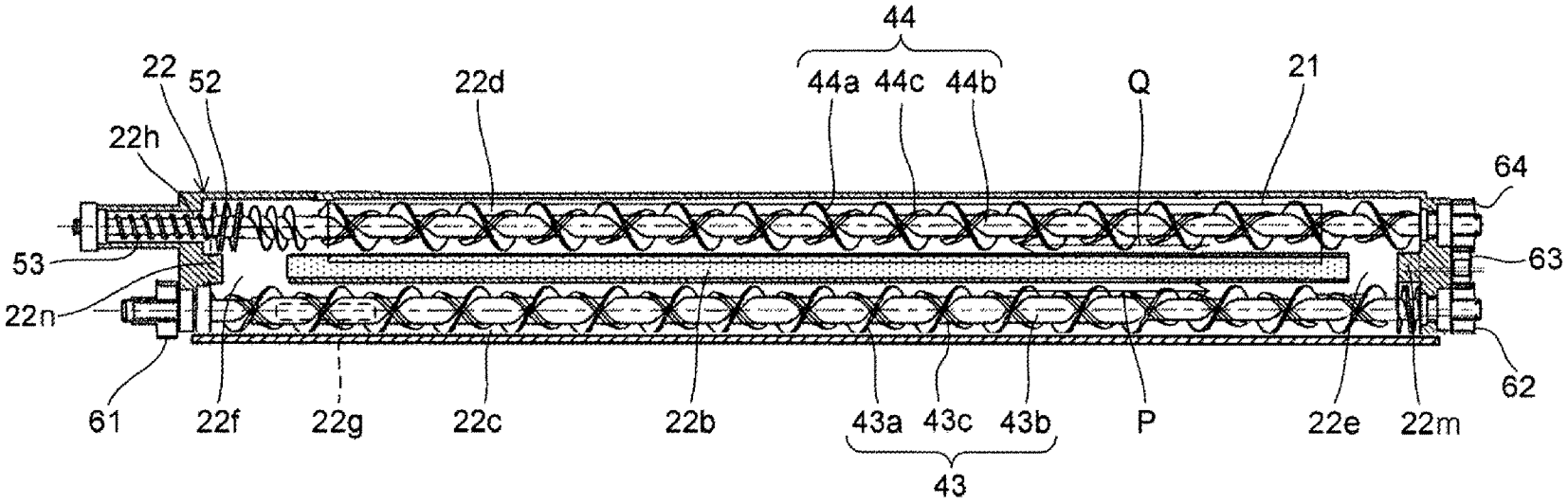
FIG. 3 is a cross-sectional plan view illustrating a stirring section of the developing device 2*a* of the present disclosure.

Next, the following describes a stirring section of the developing device 2*a* in detail with reference to FIG. 3. FIG. 3 is a cross-sectional plan view (a cross-sectional view taken along a line III-III in FIG. 2) illustrating the stirring section of the developing device 2*a*.

As illustrated in FIG. 3, the first conveyance chamber 22*c*, the second conveyance chamber 22*d*, and the partition 22*b* are formed in the developer container 22 as described above. In addition to the above, the developer container 22 includes an upstream-side communication area (a communication area) 22*e*, a downstream-side communication area (a communication area) 22*f*, a developer replenishment port (a toner replenishment port) 22*g*, a developer discharge port 22*h*, an upstream-side wall portion 22*m*, and a downstream-side wall portion 22*n*. In the first conveyance chamber 22*c* illustrated in FIG. 3, the left side is the upstream side and the right side is the downstream side. By contrast, in the second conveyance chamber 22*d* illustrated in FIG. 3, the right side is the upstream side and the left side is the downstream side. Therefore, the communication areas and the wall portions are denoted with "upstream-side" or "downstream-side" depending on which side of the second conveyance chamber 22*d* they are located.

The partition 22*b* extends in a lengthwise direction of the developer container 22 such that the developer container 22 is partitioned into the first conveyance chamber 22*c* and the second conveyance chamber 22*d* arranged side by side. The upstream-side communication area 22*e* is formed between the right end of the partition 22*b* and an inside wall portion of the upstream-side wall portion 22*m*. On the other hand, the downstream-side communication area 22*f* is formed between the left end of the partition 22*b* and an inside wall portion of the downstream-side wall portion 22*n*. The developer circulates within the developer container 22 by passing through the first conveyance chamber 22*c*, the upstream-side communication area 22*e*, the second conveyance chamber 22*d*, and the downstream-side communication area 22*f* in order.

The developer replenishment port 22*g* is an opening for replenishing the toner and the carrier from a developer replenishment container (not illustrated) into the developer container 22. The developer replenishment container is located in an upper part of the developer container 22, and the developer replenishment port 22*g* is located on the upstream side (the left side in FIG. 3) of the first conveyance chamber 22*c*.

The developer discharge port 22*h* is an opening for discharging a surplus of the replenished developer from the first conveyance chamber 22*c* and the second conveyance chamber 22*d*. The developer discharge port 22*h* is provided to be continuous with the downstream side of the second conveyance chamber 22*d* in a lengthwise direction thereof.

The first spiral 43 includes a rotary shaft 43*b*, a first spiral blade 43*a*, and a second spiral blade 43*c*. The first spiral blade 43*a* has the shape of a spiral wound around the rotary shaft 43*b* with a uniform pitch in an axial direction of the rotary shaft 43*b*. The second spiral blade 43*c* has the shape of a spiral wound around the rotary shaft 43*h* with the same pitch as the first spiral blade 43*a* in the axial direction of the rotary shaft 43*b*. The second spiral blade 43*c* is wound in a direction opposite (in a phase opposite) to the first spiral blade 43*a*. Also, the first spiral blade 43*a* and the second spiral blade 43*c* extend to the opposite ends in a lengthwise direction of the first conveyance chamber 22*c*. The first spiral blade 43*a* and the second spiral blade 43*c* are also provided in regions opposite to the upstream-side communication area 22*e* and the downstream-side communication area 22*f*, The rotary shaft 43*b* is supported by the upstream-side wall portion 22*m* and the downstream-side wall portion 22*n* of the developer container 22 so as to be rotatable. Note that the first spiral blade 43*a* and the second spiral blade 43*c* are formed integrally with the rotary shaft 43*b* from a synthetic resin.

The second spiral 44 includes a rotary shaft 44*b*, a first spiral blade 44*a*, and a second spiral blade 44*c*. The first spiral blade 44*a* has the shape of a spiral wound around the rotary shaft 44*b* with a uniform pitch in an axial direction of the rotary shaft 44*b*. The second spiral blade 44*c* has the shape of a spiral wound around the rotary shaft 44*b* with the same pitch as the first spiral blade 44*a* in the axial direction of the rotary shaft 44*b*. The second spiral blade 44*c* is wound in a direction opposite (in a phase opposite) to the first spiral blade 44*a*. The first spiral blade 44*a* has the shape of a spiral wound with the same pitch as the first spiral blade 43*a* of the first spiral 43. The first spiral blade 44*a* is wound in a direction opposite (in a phase opposite) to the first spiral blade 43*a* of the first spiral 43. Also, the first spiral blade 44*a* and the second spiral blade 44*c* each have a length longer than a length of the magnetic roller 21 in an axial direction thereof. Further, the first spiral blade 44*a* and the second spiral blade 44*c* also extend to a region opposite to the upstream-side communication area 22*e*. The rotary shaft 44*b* is arranged parallel to the rotary shaft 43*b*. The rotary shaft 44*b* is supported by the upstream-side wall portion 22*m* and the downstream-side wall portion 22*n* of the developer container 22 so as to be rotatable. Further, in addition to the first spiral blade 44*a* and the second spiral blade 44*c*, a regulation part 52 and a discharge blade 53 are provided integrally with the rotary shaft 44*b*. Details of configurations of the first spiral blades 43*a* and 44*a* and the second spiral blades 43*c* and 44*c* will be described further below.

The regulation part 52 dams the developer conveyed to the downstream side of the second conveyance chamber 22*d*, and conveys an excess of the developer above a specific amount to the developer discharge port 22*h*. The regulation part 52 is formed from a spiral blade wound in a direction opposite (in a phase opposite) to the first spiral blade 44*a* provided on the rotary shaft 44*b*. The outer diameter of the spiral blade forming the regulation part 52 is substantially the same as the outer diameter of the first spiral blade 44*a*. The pitch of the spiral blade forming the regulation part 52 is set to be smaller than the pitch of the first spiral blade 44*a*. Also, a gap of a specific size is formed between an inside wall portion of the developer container 22 including the downstream-side wall portion 22*n* and the periphery of the regulation part 52. A surplus of the developer is discharged through the gap.

The rotary shaft 44*b* extends to within the developer discharge port 22*h*. The discharge blade 53 is provided on a part of the rotary shaft 44*b* located in the developer discharge port 22*h*. Therefore, the discharge blade 53 also rotates along with rotation of the rotary shaft 44*b*. The discharge blade 53 is a spiral blade wound in the same direction as the first spiral blade 44*a*. The pitch of the discharge blade 53 is smaller than the pitch of the first spiral blade 44*a*. The outer diameter of the discharge blade 53 is smaller than the outer diameter of the first spiral blade 44*a*.

Therefore, when the rotary shaft 44*b* rotates, a surplus of the developer conveyed to the developer discharge port 22*h* over the regulation part 52 is sent leftward in FIG. 3 and discharged to the outside of the developer container 22. The discharge blade 53, the regulation part 52, the first spiral blade 44*a*, and the second spiral blade 44*c* may be formed integrally with the rotary shaft 44*b* from a synthetic resin.

Gears 61 to 64 are provided on the outside wall of the developer container 22. The gears 61 and 62 are fixed to the rotary shaft 43*b*, and the gear 64 is fixed to the rotary shaft 44*b*. The gear 63 is supported by the developer container 22 so as to be rotatable, and engages with the gears 62 and 64.

In the first spiral 43 of the above-described configuration, the first spiral blade 43*a* is provided on the outer circumferential surface of the rotary shaft 43*b*. Through rotation of the rotary shaft 43*b*, the first spiral blade 43*a* conveys the developer in a first direction (a direction indicated by an arrow P in FIG. 3) while stirring the developer. Also, the second spiral blade 43*c* is provided on the outer circumferential surface of the rotary shaft 43*b* in pitch spaces (i.e., between adjacent turns) of the first spiral blade 43*a*. The second spiral blade 43*c* is in a phase opposite to the first spiral blade 43*a*. The second spiral blade 43*c* has a smaller diameter than the first spiral blade 43*a*. Through rotation of the rotary shaft 43*b*, the second spiral blade 43*c* generates a conveying effect by which the developer is conveyed in a second direction (a direction indicated by an arrow Q in FIG. 3) that is opposite to the first direction.

Also, in the second spiral 44 of the above-described configuration, the first spiral blade 44*a* is provided on the outer circumferential surface of the rotary shaft 44*b*. Through rotation of the rotary shaft 44*b*, the first spiral blade 44*a* conveys the developer in a first direction (the direction indicated by the arrow Q in FIG. 3) while stirring the developer. Also, the second spiral blade 44*c* is provided on the outer circumferential surface of the rotary shaft 44*b* in pitch spaces (i.e., between adjacent turns) of the first spiral blade 44*a*. The second spiral blade 44*c* is in a phase opposite to the first spiral blade 44*a*. The second spiral blade 44*c* has a smaller diameter than the first spiral blade 44*a*. Through rotation of the rotary shaft 44*b*, the second spiral blade 44*c* generates a conveying effect by which the developer is conveyed in a second direction (the direction indicated by the arrow P in FIG. 3) that is opposite to the first direction.

The second spiral blades 43*c* and 44*c* are located on the inside of the peripheries of the first spiral blades 43*a* and 44*a* in radial directions. Therefore, the conveying effects generated in the second direction by the rotation of the second spiral blades 43*c* and 44*c* act on a portion of the developer near the rotary shafts 43*b* and 44*b*. Therefore, conveying effects of the first spiral blades 43*a* and 44*a* in the first direction are almost uninhibited.

As described above, through use of the second spiral blades 43*c* and 44*c*, the conveying effects are generated in the direction (the second direction) opposite to the conveyance direction (the first direction) of the developer by the first spiral blades 43*a* and 44*a*. As a result, a convective flow of the developer is generated in the pitch spaces of the first spiral blades 43*a* and 44*a*. Through the above, stirring of the developer is promoted between adjacent turns of the first spiral blades 43*a* and 44*a* with almost no inhibition of the conveyance effects of the first spiral blades 43*a* and 44*a* on the powder (developer). Therefore, the toner and the carrier replenished via the developer replenishment port 22*g* can be rapidly and effectively stirred together with the two-component developer within the first conveyance chamber 22*c* and the second conveyance chamber 22*d*. Also, reduction in developer conveyance speed within the first conveyance chamber 22*c* and the second conveyance chamber 22*d* can be effectively prevented.

Note that a stirring effect may decrease due to failure to sufficiently generate the convective flow of the developer in the pitch spaces of the first spiral blades 43*a* and 44*a* in a configuration in which a height (a radial height R2, see FIG. 5) of the edge of the second spiral blade 43*c* from the rotary shaft 43*b* is lower than ¼ of a height (a radial height R1, see FIG. 5) of the edge of the first spiral blade 43*a* from the rotary shaft 43*b*, and in a configuration in which a height (a radial height R2) of the edge of the second spiral blade 44*c* from the rotary shaft 44*b* is lower than ¼ of a height (a radial height R1) of the edge of the first spiral blade 44*a* from the rotary shaft 44*b*. By contrast, in a configuration in which R2 is higher than ½ of R1, conveying force of the second spiral blades 43*c* and 44*c* in the second direction may become excessively large and the conveying effects of the first spiral blades 43*a* and 44*a* in the first direction may be inhibited.

Therefore, the radial height R2 of the second spiral blade 43*c* is preferably at least ¼ and no greater than ½ of the radial height R1 of the first spiral blade 43*a*, and the radial height R2 of the second spiral blade 44*c* is preferably at least ¼ and no greater than ½ of the radial height R1 of the first spiral blade 44*a*. Through the above, reduction in conveyance speed can be effectively prevented while generating the convective flow of the developer in the pitch spaces of the first spiral blades 43*a* and 44*a*.

The following describes details of the configuration of the first spiral blade 43*a* and the second spiral blade 43*c* of the first spiral 43 according to the first embodiment with reference to FIGS. 4 to 7. The first spiral 43 is located within the first conveyance chamber 22*c*. Note that the first spiral blade 44*a* and the second spiral blade 44*c* of the second spiral 44 located within the second conveyance chamber 22*d* have the same configuration as the first spiral blade 43*a* and the second spiral blade 43*c* of the first spiral 43. Therefore, explanation of the configuration of the first spiral blade 44*a* and the second spiral blade 44*c* of the second spiral 44 will be omitted.

Figure 4:
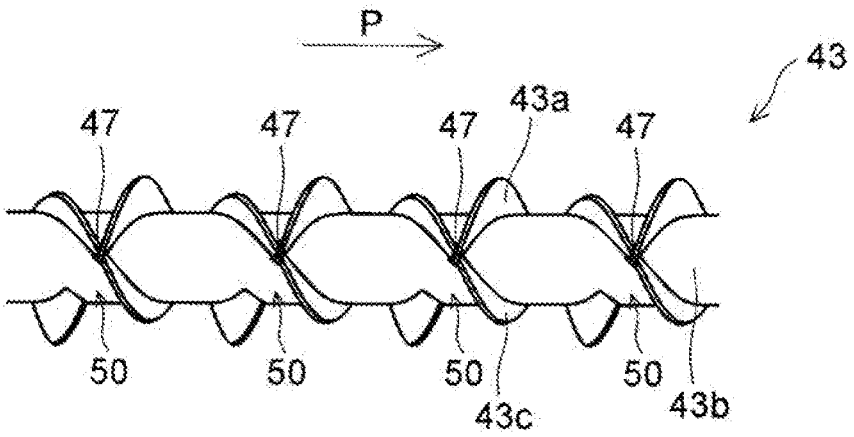
FIG. 4 is an enlarged partial view of the first spiral 43 as the stirring conveyance member of the present disclosure, taken from a direction perpendicular to a rotary shaft 43*b*.
Figure 5:
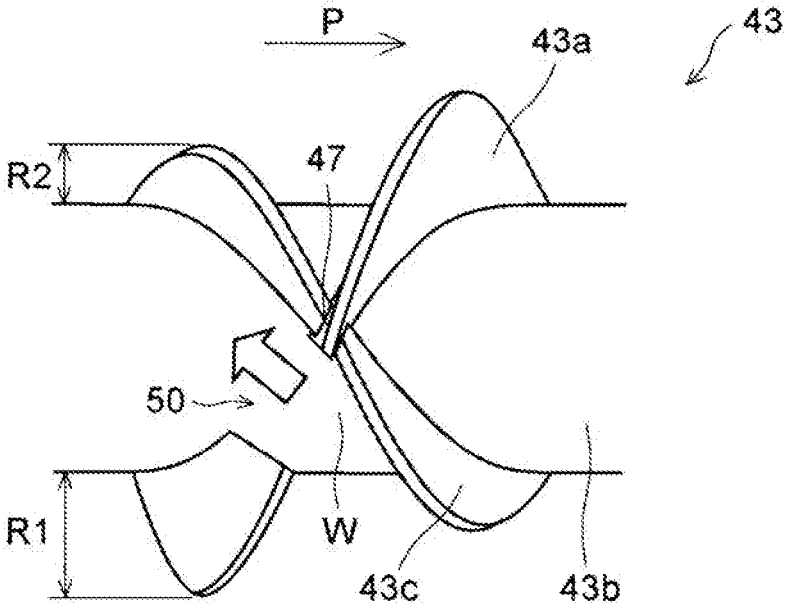
FIG. 5 is an enlarged partial view of the first spiral 43 as the stirring conveyance member of the present disclosure, taken from a direction perpendicular to the rotary shaft 43*b*.

As illustrated in FIGS. 4 and 5, the first spiral blade 43*a* and the second spiral blade 43*c* each have a trapezoidal cross section in a plane transverse to a lengthwise direction of the spiral blade. The first spiral blade 43*a* constitutes the first spiral 43. In each turn of the first spiral blade 43*a* and the second spiral blade 43*c* around the rotary shaft 43*b*, the first spiral blade 43*a* and the second spiral blade 43*c* intersect each other at two intersection points 47 spaced apart from each other by 180°. The radial height R2 of the second spiral blade 43*c* is lower than the radial height R1 of the first spiral blade 43*a*.

Figure 6:
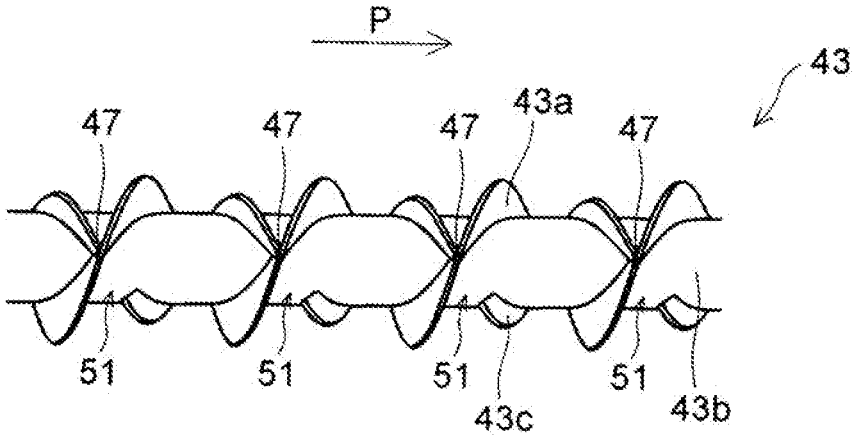
FIG. 6 is an enlarged partial view of the first spiral 43 as the stirring conveyance member of the present disclosure, taken from a direction perpendicular to the rotary shaft 43*b* and illustrating a structure of the back side of the first spiral 43 illustrated in FIG. 4.
Figure 7:
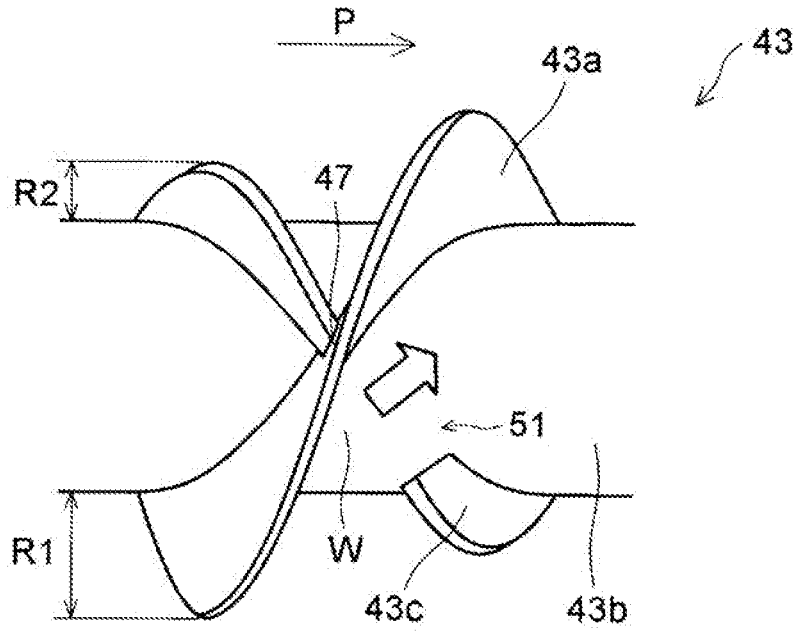
FIG. 7 is an enlarged partial view of the first spiral 43 as the stirring conveyance member of the present disclosure, taken from a direction perpendicular to the rotary shaft 43*b* and illustrating a structure of the back side of the first spiral 43 illustrated in FIG. 5.

Specifically, the radial height R1 of the first spiral blade 43*a* is constant except in the vicinities of the intersection points 47 (i.e., except in first cutouts 50). The first spiral blade 43*a* has the first cutouts 50 each formed in a specific region adjacent to and upstream (on the left in FIGS. 4 and 5) of one of the intersection points 47 in the conveyance direction of the developer by the first spiral blade 43*a*. The radial height R1 of portions of the first spiral blade 43*a* where the first cutouts 50 are formed is lower than the radial height R2 of portions of the second spiral blade 43*c* where second cutouts 51 described below are not formed. Also, as illustrated rated in FIGS. 6 and 7, the radial height R2 of the second spiral blade 43*c* is constant except in the vicinities of the intersection points 47 (i.e., except in the second cutouts 51). Note that FIGS. 6 and 7 illustrate the back side of the first spiral 43 illustrated in FIGS. 4 and 5. FIGS. 6 and 7 illustrate a state where the rotary shaft 43*b* is rotated by half-turn (180°) from the state illustrated in FIGS. 4 and 5. The second spiral blade 43*c* has the second cutouts 51 each formed in a specific region adjacent to and upstream (on the right in FIGS. 6 and 7) of one of the intersection points 47 in the conveyance direction of the developer by the second spiral blade 43*c*.

Therefore, the developer present in regions W located in the vicinities and downstream of (below in FIGS. 5 and 7) the intersection points 47 in a rotation direction of the rotary shaft 43*b* passes and disperses through the first cutouts 50 and the second cutouts 51. As a result, stagnation of the developer is prevented. Note that in the present embodiment, the first cutouts 50 are formed to reach the outer circumferential surface of the rotary shaft 43*b*. That is, the radial height R1 of the portions of the first spiral blade 43*a* where the first cutouts 50 are formed is zero. Also, the second cutouts 51 are formed to reach the outer circumferential surface of the rotary shaft 43*b*. That is, the radial height R2 of portions of the second spiral blade 43*c* where the second cutouts 51 are formed is zero.

Only one first cutout 50 is formed in each turn of the first spiral blade 43*a* around the rotary shaft 43*b*. That is, the first cutouts 50 are formed not for all the intersection points 47, but for every second intersection point 47. Also, only one second cutout 51 is formed in each turn of the second spiral blade 43*c* around the rotary shaft 43*b*. That is, the second cutouts 51 are formed not for all the intersection points 47, but for every second intersection point 47. Note that the first cutout 50 and the second cutout 51 are not formed for the same intersection point 47, but are alternately formed for the intersection points 47 (at every 180°).

The first cutouts 50 are each formed to have, in the circumferential direction of the rotary shaft 43*b*, a dimension of an arc having a central angle of at least 60° and no greater than 120°. Also, the second cutouts 51 are each formed to have, in the circumferential direction of the rotary shaft 43*b*, a dimension of an arc having a central angle of at least 60° and smaller than 180°. Note that the first cutouts 50 and the second cutouts 51 are formed such that in the axial direction of the rotary shaft 43*b*, regions in which the first cutouts 50 are formed do not overlap with regions in which the second cutouts 51 are formed.

In the present embodiment, the first spiral blade 43*a* has the first cutouts 50 formed in the specific regions adjacent to and upstream of the intersection points 47 in the conveyance direction of the developer by the first spiral blade 43*a*, as described above. Further, the radial height R1 of the portions of the first spiral blade 43*a* where the first cutouts 50 are formed is lower than the radial height R2 of the portions of the second spiral blade 43*c* where the second cutouts 51 are not formed. Also, the second spiral blade 43*c* has the second cutouts 51 formed in the specific regions adjacent to and upstream of the intersection points 47 in the conveyance direction of the developer by the second spiral blade 43*c*. Therefore, the developer present in the regions W located in the vicinities and downstream of the intersection points 47 in the rotation direction of the rotary shaft 43*b* passes and disperses through the first cutouts 50 and the second cutouts 51. As a result, stagnation of the developer is prevented and stirring performance is improved.

Similarly, the first spiral blade 44*a* of the second spiral 44 has first cutouts 50 formed in specific regions adjacent to and upstream of the intersection points 47 in the conveyance direction of the developer by the first spiral blade 44*a*. Further, the radial height R1 of portions of the first spiral blade 44*a* where the first cutouts 50 are formed is lower than the radial height R2 of portions of the second spiral blade 44*c* where second cutouts 51 are not formed. Also, the second spiral blade 44*c* has the second cutouts 51 formed in specific regions adjacent to and upstream of the intersection points 47 in the conveyance direction of the developer by the second spiral blade 44*c*. Therefore, the developer present in regions W located in the vicinities and downstream of the intersection points 47 in a rotation direction of the rotary shaft 44*b* passes and disperses through the first cutouts 50 and the second cutouts 51. As a result, stagnation of the developer is prevented and the stirring performance can be improved.

Also, as described above, the first cutouts 50 are each formed to have, in the circumferential direction of the rotary shaft 43*b* or 44*b*, a dimension of an arc having a central angle of at least 60° and no greater than 120". As a result, the developer stirring performance can be easily improved while maintaining conveying force of the first spiral blades 43*a* and 44*a* exerted on the developer.

Also, as described above, the second cutouts 51 are each formed to have, in the circumferential direction of the rotary shaft 43*b* or 44*b*, a dimension of an arc having a central angle of at least 60° and smaller than 180°. As a result, the developer stirring performance can be easily improved while maintaining conveying force of the second spiral blades 43*c* and 44*c* exerted on the developer in the opposite direction.

Also, the first cutouts 50 and the second cutouts 51 are formed such that in the axial directions of the rotary shafts 43*b* and 44*b*, regions in which the first cutouts 50 are formed do not overlap with regions in which the second cutouts 51 are formed, as described above. Therefore, the rotary shaft 43*b* is prevented from having a region in its axial direction where neither of the first spiral blade 43*a* and the second spiral blade 43*c* is formed. Also, the rotary shaft 44*b* is prevented from having a region in its axial direction where neither of the first spiral blade 44*a* and the second spiral blade 44*c* is formed. As a result, stagnation of the developer in such a region is prevented.

Also, the radial height R1 of the portions of the first spiral blades 43*a* and 44*a* where the first cutouts 50 are formed is zero, as described above. Therefore, the developer easily passes through the first cutouts 50, resulting in sufficient improvement in the developer stirring performance.

Also, the radial height R2 of the portions of the second spiral blades 43*c* and 44*c* where the second cutouts 51 are formed is zero, as described above. Therefore, the developer easily passes through the second cutouts 51, resulting in sufficient improvement in the developer stirring performance.

Also, as described above, the configuration of the present disclosure is applied to both the first spiral 43 within the first conveyance chamber 22*c* and the second spiral 44 within the second conveyance chamber 22*d*. As a result, stagnation of the developer is prevented and the stirring performance is improved in both the first conveyance chamber 22*c* and the second conveyance chamber 22*d*. Further, the developer conveyance speed in the first conveyance chamber 22*c* and the developer conveyance speed in the second conveyance chamber 22*d* can be easily made substantially the same.

The following describes the effects of the present disclosure more specifically, using an example.

The developing devices 2*a* to 2*d* as illustrated in FIGS. 2 and 3 were installed in the image forming apparatus 1 as illustrated in FIG. 1, and a test was conducted on a charge amount of the toner by changing the configuration of the first spiral 43 within the first conveyance chamber 22*c*. Note that the test was conducted using the image forming section for magenta color including the developing device 2*a*.

In the example, the diameter of the rotary shaft 43*b* of the first spiral 43 was set at 8 mm, the diameter of the first spiral blade 43*a* was set at 20 mm (the radial height R1 was set at 6 mm), the pitch of the first spiral blade 43*a* was set at 20 mm, the diameter of the second spiral blade 43*c* was set at 12 mm (the radial height R2 was set at 2 mm), the pitch of the second spiral blade 43*c* was set at 20 mm, and the lengths of the first spiral blade 43*a* and the second spiral blade 43*c* in axial directions thereof were set at 330 mm. Also, the first cutouts 50 were formed in the first spiral blade 43*a* as illustrated in FIG. 5. Only one first cutout 50 was formed in each turn of the first spiral blade 43*a* around the rotary shaft 43*b*. The first cutouts 50 each had, in the circumferential direction of the rotary shaft 43*b*, a dimension of an arc having a central angle of 60° and reached the outer circumferential surface of the rotary shaft 43*h*. Also, the second cutouts 51 were formed in the second spiral blade 43*c* as illustrated in FIG. 7. Only one second cutout 51 was formed in each turn of the second spiral blade 43*c* around the rotary shaft 43*b*. The second cutouts 51 each had, in the circumferential direction of the rotary shaft 43*b*, a dimension of an arc having a central angle of 60° and reached the outer circumferential surface of the rotary shaft 43*b*. The above-described first spiral 43 was used in a configuration of the example.

In a comparative example, the first cutouts 50 and the second cutouts 51 were not formed in the first spiral 43. The first spiral 43 that was the same as the first spiral 43 of the example in all aspects other than the above change was used in a configuration of the comparative example.

The developing devices 2*a* of the example and the comparative example were each filled with 150 $cm^3$ of a two-component developer prepared by mixing a positively chargeable toner having an average particle diameter of 6.8 μm and a resin coated ferrite carrier having an average particle diameter of 35 μm. Then, 1 g of a toner (hereinafter may be referred to as a replenishment toner) of a color different from a color of the toner in the developing device 2*a* was replenished from the upstream end of the first conveyance chamber 22*c* and conveyed while being stirred from the upstream end to the downstream end of the first spiral 43. Thereafter, the replenishment toner was taken out and an amount of increase in charge amount of the replenishment toner was determined on the basis of charge amounts of the replenishment toner measured before and after the replenishment toner was conveyed while being stirred. Note that this experiment was conducted at absolute humidities of 10 $g/m^3$ and 20 $g/m^3$. Results of the experiment are shown in Table 1.

TABLE 1

| Absolute humidity | Amount of increase in charge amount of replenishment toner [μC/g] | |
|---|---|---|
| [$g/m^3$] | Example | Comparative example |
| 10 | 6.8 | 3.5 |
| 20 | 4.4 | 2.4 |

As indicated in Table 1 in the example where the first cutouts 50 were formed in the first spiral blade 43*a* and the second cutouts 51 were formed in the second spiral blade 43*c*, an amount of increase in the charge amount of the replenishment toner was 6.8 μC/g when the absolute humidity was 10 $g/m^3$ and 4.4 μC/g when the absolute humidity was 20 $g/m^3$.

By contrast, in the comparative example where the first cutouts 50 and the second cutouts 51 were not formed in the first spiral 43, an amount of increase in the charge amount of the replenishment toner was only 3.5 μc/g when the absolute humidity was 10 $g/m^3$, and only 2.4 μC/g when the absolute humidity was 20 $g/m^3$. Note that when an amount of increase in the charge amount of the replenishment toner is 3.0 μC/g or less, fogging may occur by adhesion of the toner to a blank part in which no image is formed.

From the above results, it was confirmed that the configuration of the example increases the charge amount of the toner further than the configuration of the comparative example. The reason for this is thought as follows: in the example where the first cutouts 50 and the second cutouts 51 were formed in the first spiral 43, the developer present in the regions W (see FIGS. 5 and 7) located in the vicinities and downstream of the intersection points 47 in the rotation direction of the rotary shaft 43*b* passed and dispersed through the first cutouts 50 and the second cutouts 51, and as a result, stagnation of the developer was prevented and the stirring performance was improved.

[Second Embodiment]

In the first embodiment, the first cutouts 50 are formed in the first spiral blade 43*a* and the second cutouts 51 are formed in the second spiral blade 43*c*. However, it is possible to employ a configuration in which only the first spiral blade 43*a* has cutouts 50 and the second spiral blade 43*c* has no cutouts. The first spiral blade 43*a* and the second spiral blade 43*c* of the second embodiment have the same configuration as the first spiral blade 43*a* and the second spiral blade 43*c* of the first embodiment in all aspects other than that in the second embodiment, no cutouts are formed in the second spiral blade 43*c* and the cutouts 50 are formed in the first spiral blade 43*a* only.

The following describes details of the configuration of the first spiral blade 43*a* and the second spiral blade 43*c* of the first spiral 43 according to the second embodiment with reference to FIGS. 4 and 5. The first spiral 43 is located within the first conveyance chamber 22*c*. Note that the first spiral blade 44*a* and the second spiral blade 44*c* of the second spiral 44 located within the second conveyance chamber 22*d* have the same configuration as the first spiral blade 43*a* and the second spiral blade 43*c* of the first spiral 43. Therefore, explanation of the configuration of the first spiral blade 44*a* and the second spiral blade 44*c* of the second spiral 44 will be omitted.

As illustrated in FIGS. 4 and 5, the first spiral blade 43*a* and the second spiral blade 43*c* of the first spiral 43 each have a trapezoidal cross section in a plane transverse to a lengthwise direction of the spiral blade. In each turn of the first spiral blade 43*a* and the second spiral blade 43*c* around the rotary shaft 43*b*, the first spiral blade 43*a* and the second spiral blade 43*c* intersect each other at two intersection points 47 spaced apart from each other by 180°. The radial height R2 of the second spiral blade 43*c* is lower than the radial height R1 of the first spiral blade 43*a*.

Specifically, the radial height R2 of the second spiral blade 43*c* is constant. The radial height R1 of the first spiral blade 43*a* is constant except in the vicinities of the intersection points 47 (i.e., except in the cutouts 50). The first spiral blade 43*a* has the cutouts 50 each formed in a specific region adjacent to and upstream (on the left in FIGS. 4 and 5) of one of the intersection points 47 in the conveyance direction of the developer by the first spiral blade 43*a*. The radial height R1 of portions of the first spiral blade 43*a* where the cutouts 50 are formed is lower than the radial height R2 of the second spiral blade 43*c*. Therefore, the developer present in the regions W located in the vicinities and downstream of (below in FIG. 5) the intersection points 47 in the rotation direction of the rotary shaft 43*b* passes and disperses through the cutouts 50, and as a result, stagnation of the developer is prevented. Note that in the present embodiment, the cutouts 50 are formed to reach the outer circumferential surface of the rotary shaft 43*b*. Therefore, the radial height R1 of the first spiral blade 43*a* in the portions where the cutouts 50 are formed is zero.

Only one cutout 50 is formed in each turn of the first spiral blade 43*a* around the rotary shaft 43*b*. That is, the cutouts 50 are formed not for all the intersection points 47, but for every second intersection point 47. Also, the cutouts 50 are each formed to have, in the circumferential direction of the rotary shaft 43*b*, a dimension of an arc having a central angle of at least 60° and no greater than 120°.

In the present embodiment, the first spiral blade 43*a* has the cutouts 50 formed in the specific regions adjacent to and upstream of the intersection points 47 in the conveyance direction of the developer by the first spiral blade 43*a*, and the radial height R1 of the portions of the first spiral blade 43*a* where the cutouts 50 are formed is lower than the radial height R2 of the second spiral blade 43*c*, as described above. Therefore, the developer present in the regions W located in the vicinities and downstream of the intersection points 47 in the rotation direction of the rotary shaft 43*b* passes and disperses through the cutouts 50. As a result, stagnation of the developer is prevented and the stirring performance is improved.

Similarly, the first spiral blade 44*a* of the second spiral 44 has cutouts 50 foil led in specific regions adjacent to and upstream of the intersection points 47 in the conveyance direction of the developer by the first spiral blade 44*a*. Also, the radial height R1 of portions of the first spiral blade 44*a* where the cutouts 50 are formed is lower than the radial height R2 of the second spiral blade 44*c*. Therefore, the developer present in the regions W located in the vicinities and downstream of the intersection points 47 in the rotation direction of the rotary shaft 44*b* passes and disperses through the cutouts 50. As a result, stagnation of the developer is prevented and the stirring performance is improved.

Also, since the second spiral blades 43*c* and 44*c* are formed continuously without being cut at the intersection points 47, the conveying force of the second spiral blades 43*c* and 44*c* in the opposite direction does not decrease, resulting in prevention of decrease in the stirring effect on the developer.

Also, the cutouts 50 are each formed to have, in the circumferential direction of the rotary shaft 43*b* or 44*b*, a dimension of an arc having a central angle of at least 60° and no greater than 120°, as described above. Therefore, the developer stirring performance can be easily improved while maintaining conveying force of the first spiral blades 43*a* and 44*a* exerted on the developer.

Also, the radial height R1 of the first spiral blades 43*a* and 44*a* in the portions where the cutouts 50 are formed is zero, as described above. Therefore, the developer easily passes through the cutouts 50, resulting in sufficient improvement in the developer stirring performance.

Also, as described above, the configuration of the present disclosure is applied to both the first spiral 43 within the first conveyance chamber 22*c* and the second spiral 44 within the second conveyance chamber 22*d*. Therefore, stagnation of the developer is prevented and the stirring performance is improved in both the first conveyance chamber 22*c* and the second conveyance chamber 22*d*. Further, the developer conveyance speed in the first conveyance chamber 2*c* and the developer conveyance speed in the second conveyance chamber 22*d* can be easily made substantially the same.

The following describes the effects of the present disclosure more specifically, using an example.

The developing devices 2*a* to 2*d* as illustrated in FIGS. 2 and 3 were installed in the image forming apparatus 1 as illustrated in FIG. 1, and a test was conducted on a charge amount of the toner by changing the configuration of the first spiral 43 within the first conveyance chamber 22*c*. Note that the test was conducted using the image forming section for magenta color including the developing device 2*a*.

In the example, the diameter of the rotary shaft 43*b* of the first spiral 43 was set at 8 mm, the diameter of the first spiral blade 43*a* was set at 20 mm (the radial height R1 was set at 6 mm), the pitch of the first spiral blade 43*a* was set at 20 mm, the diameter of the second spiral blade 43*c* was set at 12 mm (the radial height R2 was set at 2 mm), the pitch of the second spiral blade 43*c* was set at 20 mm, and the lengths of the first spiral blade 43*a* and the second spiral blade 43*c* in axial directions thereof were set at 330 mm. Also, the cutouts 50 were formed in the first spiral blade 43*a* as illustrated in FIG. 5. Only one cutout 50 was formed in each turn of the first spiral blade 43*a* around the rotary shaft 43*b*. The cutouts 50 each had, in the circumferential direction of the rotary shaft 43*b*, a dimension of an arc having a central angle of 60° and reached the outer circumferential surface of the rotary shaft 43*b*. Note that no cutouts were formed in the second spiral blade 43*c*. The above-described first spiral 43 was used in a configuration of the example.

In a comparative example, the cutouts 50 were not formed in the first spiral 43. The first spiral 43 that was the same as the first spiral 43 of the example in all aspects other than the above change was used in a configuration of the comparative example.

The developing devices 2*a* of the example and the comparative example were each filled with 150 $cm^3$ of a two-component developer prepared by mixing a positively chargeable toner having an average particle diameter of 6.8 μm and a resin coated ferrite carrier having an average particle diameter of 35 μm. Then, 1 g of a toner (hereinafter may be referred to as a replenishment toner) of a color different from a color of the toner in the developing device 2*a* was replenished from the upstream end of the first conveyance chamber 22*c* and conveyed while being stirred from the upstream end to the downstream end of the first spiral 43. Thereafter, the replenishment toner was taken out and an amount of increase in charge amount of the replenishment toner was determined on the basis of charge amounts of the replenishment toner measured before and after the replenishment toner was conveyed while being stirred. Note that this experiment was conducted at absolute humidities of 10 $g/m^3$ and 20 $g/m^3$. Results of the experiment are shown in Table 2.

TABLE 2

| Absolute humidity | Amount of increase in charge amount of replenishment toner [μC/g] | |
|---|---|---|
| [$g/m^3$] | Example | Comparative example |
| 10 | 6.6 | 3.5 |
| 20 | 4.3 | 2.4 |

As indicated in Table 2, in the example where the cutouts 50 were formed in the first spiral blade 43*a*, an amount of increase in the charge amount of the replenishment toner was 6.6 μC/g when the absolute humidity was 10 g/m$^3$, and 4.3 μC/g when the absolute humidity was 20 g/m$^3$.

By contrast, in the comparative example where the cutouts 50 were not formed in the first spiral blade 43*a*, an amount of increase in the charge amount of the replenishment toner was only 3.5 μC/g when the absolute humidity was 10 g/m$^3$, and only 2.4 μt/g when the absolute humidity was 20 g/m$^3$. Note that when an amount of increase in the charge amount of the replenishment toner is 3.0 μC/g or less, fogging may occur by adhesion of the toner to a blank part in which no image is formed.

From the above results, it was confirmed that the configuration of the example increases the charge amount of the toner further than the configuration of the comparative example. The reason for this is thought as follows: in the example where the cutouts 50 were formed in the first spiral blade 43*a* in the specific regions adjacent to and upstream of the intersection points 47 in the conveyance direction of the developer, the developer present in the regions W (see FIG. 5) located in the vicinities and downstream of the intersection points 47 in the rotation direction of the rotary shaft 43*b* passed and dispersed through the cutouts 50, and as a result, stagnation of the developer was prevented and the stirring performance was improved.

[Third Embodiment]

In the first embodiment, the first cutouts 50 are formed in the first spiral blade 43*a* and the second cutouts 51 are formed in the second spiral blade 43*c*. However, it is possible to employ a configuration in which the first spiral blade 43*a* has no cutouts and only the second spiral blade 43*c* has cutouts 51. The first spiral blade 43*a* and the second spiral blade 43*c* of the third embodiment have the same configuration as the first spiral blade 43*a* and the second spiral blade 43*c* of the first embodiment in all aspects other than that in the third embodiment, no cutouts are formed in the first spiral blade 43*a* and the cutouts 51 are formed in the second spiral blade 43*c* only.

The following describes details of the configuration of the first spiral blade 43*a* and the second spiral blade 43*c* of the first spiral 43 located within the first conveyance chamber 22*c* according to the third embodiment with reference to FIGS. 6 and 7. Note that the first spiral blade 44*a* and the second spiral blade 44*c* of the second spiral 44 located within the second conveyance chamber 22*d* have the same configuration as the first spiral blade 43*a* and the second spiral blade 43*c* of the first spiral 43. Therefore, explanation of the configuration of the first spiral blade 44*a* and the second spiral blade 44*c* of the second spiral 44 will be omitted.

As illustrated in FIGS. 6 and 7, the first spiral blade 43*a* and the second spiral blade 43*c* of the first spiral 43 each have a trapezoidal cross section in a plane transverse to a lengthwise direction of the spiral blade. In each turn of the first spiral blade 43*a* and the second spiral blade 43*c* around the rotary shaft 43*b*, the first spiral blade 43*a* and the second spiral blade 43*c* intersect each other at two intersection points 47 spaced apart from each other by 180°. The radial height R2 of the second spiral blade 43*c* is lower than the radial height R1 of the first spiral blade 43*a*.

Specifically, the radial height R1 of the first spiral blade 43*a* is constant. The radial height R2 of the second spiral blade 43*c* is constant except in the vicinities of the intersection points 47 (i.e., except in the cutouts 51). The second spiral blade 43*c* has the cutouts 51 each foiled in a specific region adjacent to and upstream (on the right in FIGS. 6 and 7) of one of the intersection points 47 in the conveyance direction of the developer by the second spiral blade 43*c*. Therefore, the developer present in the regions W located in the vicinities and downstream of (below in FIG. 7) the intersection points 47 in the rotation direction of the rotary shaft 43*b* passes and disperses through the cutouts 51, and as a result, stagnation of the developer is prevented. Note that in the present embodiment, the cutouts 51 are formed to reach the outer circumferential surface of the rotary shaft 43*b*. Therefore, the radial height R2 of the second spiral blade 43*c* in portions where the cutouts 51 are formed is zero.

Only one cutout 51 is formed in each turn of the second spiral blade 43*c* around the rotary shaft 43*b*. That is, the cutouts 51 are formed not for all the intersection points 47, but for every second intersection point 47. Also, the cutouts 51 are each formed to have, in the circumferential direction of the rotary shaft 43*b*, a dimension of an arc having a central angle of at least 60° and smaller than 180°.

In the present embodiment, the second spiral blade 43*c* has the cutouts 51 formed in the specific regions adjacent to and upstream of the intersection points 47 in the conveyance direction of the developer by the second spiral blade 43*c*, as described above. Therefore, the developer present in the regions W located in the vicinities and downstream of the intersection points 47 in the rotation direction of the rotary shaft 43*b* passes and disperses through the cutouts 51. As a result, stagnation of the developer is prevented and the stirring performance is improved.

Similarly, the second spiral blade 44*c* of the second spiral 44 has cutouts 51 formed in specific regions adjacent to and upstream of the intersection points 47 in the conveyance direction of the developer by the second spiral blade 44*c*. Therefore, the developer present in the regions W located in the vicinities and downstream of the intersection points 47 in the rotation direction of the rotary shaft 44*b* passes and disperses through the cutouts 51. As a result, stagnation of the developer is prevented and the stirring performance is improved.

Also, since the first spiral blades 43*a* and 44*a* are formed continuously without being cut at the intersection points 47, the conveying force of the first spiral blades 43*a* and 44*a* does not decrease.

Also, the cutouts 51 are each formed to have, in the circumferential direction of the rotary shaft 43*b* or 44*b*, a dimension of an arc having a central angle of at least 60° and smaller than 180°, as described above. Therefore, the developer stirring performance can be easily improved while maintaining the conveying force of the second spiral blades 43*c* and 44*c* in the opposite direction.

Also, the radial height R2 of the second spiral blades 43*c* and 44*c* in the portions where the cutouts 51 are formed is zero, as described above. Therefore, the developer easily passes through the cutouts 51, resulting in sufficient improvement in the developer stirring performance.

Also, as described above, the configuration of the present disclosure is applied to both the first spiral 43 within the first conveyance chamber 22*c* and the second spiral 44 within the second conveyance chamber 22*d*. Therefore, stagnation of the developer is prevented and the stirring performance is improved in both the first conveyance chamber 22*c* and the second conveyance chamber 22*d*. Further, the developer conveyance speed in the first conveyance chamber 22*c* and the developer conveyance speed in the second conveyance chamber 22*d* can be easily made substantially the same.

The following describes the effects of the present disclosure more specifically, using an example.

The developing devices 2*a* to 2*d* as illustrated in FIGS. 2 and 3 were installed in the image forming apparatus 1 as illustrated in FIG. 1, and a test was conducted on a charge amount of the toner by changing the configuration of the first spiral 43 within the first conveyance chamber 22*c*. Note that the test was conducted using the image forming section for magenta color including the developing device 2*a*.

In the example, the diameter of the rotary shaft 43*b* of the first spiral 43 was set at 8 mm, the diameter of the first spiral blade 43*a* was set at 20 mm (the radial height R1 was set at 6 mm), the pitch of the first spiral blade 43*a* was set at 20 mm, the diameter of the second spiral blade 43*c* was set at 12 mm (the radial height R2 was set at 2 mm), the pitch of the second spiral blade 43*c* was set at 20 mm, and the lengths of the first spiral blade 43*a* and the second spiral blade 43*c* in axial directions thereof were set at 330 mm. Also, the cutouts 51 were formed in the second spiral blade 43*c* as illustrated in FIG. 7. Only one cutout 51 was formed in each turn of the second spiral blade 43*c* around the rotary shaft 43*b*. The cutouts 51 each had, in the circumferential direction of the rotary shaft 43*b*, a dimension of an arc having a central angle of 60° and reached the outer circumferential surface of the rotary shaft 43*b*. Note that no cutouts were formed in the first spiral blade 43*a*. The above-described first spiral 43 was used in a configuration of the example.

In a comparative example, the cutouts 51 were not formed in the first spiral 43. The first spiral 43 that was the same as the first spiral 43 of the example in all aspects other than the above change was used in a configuration of the comparative example.

The developing devices 2*a* of the example and the comparative example were each filled with 150 $cm^3$ of a two-component developer prepared by mixing a positively chargeable toner having an average particle diameter of 6.8 μm and a resin coated ferrite carrier having an average particle diameter of 35 μm. Then, 1 g of a toner (hereinafter may be referred to as a replenishment toner) of a color different from a color of the toner in the developing device 2*a* was replenished from the upstream end of the first conveyance chamber 22*c* and conveyed while being stirred from the upstream end to the downstream end of the first spiral 43. Thereafter, the replenishment toner was taken out and an amount of increase in charge amount of the replenishment toner was deter mined on the basis of charge amounts of the replenishment toner measured before and after the replenishment toner was conveyed while being stirred. Note that this experiment was conducted at absolute humidities of 10 $g/m^3$ and 20 $g/m^3$. Results of the experiment are shown in Table 3.

TABLE 3

| Absolute humidity | Amount of increase in charge amount of replenishment toner [μC/g] | |
|---|---|---|
| [$g/m^3$] | Example | Comparative example |
| 10 | 6.3 | 3.5 |
| 20 | 4.1 | 2.4 |

As indicated in Table 3, in the example where the cutouts 51 were formed in the second spiral blade 43*c*, an amount of increase in the charge amount of the replenishment toner was 6.3 μC/g when the absolute humidity was 10 $g/m^3$, and 4.1 μC/g when the absolute humidity was 20 $g/m^3$.

By contrast, in the comparative example where the cutouts 51 were not formed in the second spiral blade 43*c*, an amount of increase in the charge amount of the replenishment toner was only 3.5 μC/g when the absolute humidity was 100 $g/m^3$, and only 2.4 μC/g when the absolute humidity was 20 $g/m^3$. Note that when an amount of increase in the charge amount of the replenishment toner is 3.0 μC/g or less, fogging may occur by adhesion of the toner to a blank part in which no image is formed.

From the above results, it was confirmed that the configuration of the example increases the charge amount of the toner further than the configuration of the comparative example. The reason for this is thought as follows: in the example where the cutouts 51 were formed in the second spiral blade 43*c* in the specific regions adjacent to and upstream of the intersection points 47 in the conveyance direction of the developer, the developer present in the regions W (see FIG. 7) located in the vicinities and downstream of the intersection points 47 in the rotation direction of the rotary shaft 43*b* passed and dispersed through the cutouts 51, and as a result, stagnation of the developer was prevented and the stirring performance was improved.

Note that all aspects of the embodiments and the examples disclosed herein are examples and are not intended as specific limitations. The scope of the present disclosure is defined by claims rather than the embodiments and the examples described above, and encompasses all alterations and equivalents within the scope of the claims.

The present disclosure is applicable to developing devices used in image forming apparatuses such as an electrophotographic copier, an electrophotographic printer, an electrophotographic facsimile machine, and a multifunction peripheral including these apparatuses, and image forming apparatuses including the developing devices. In particular, the present disclosure is applicable to a stirring conveyance member of a developing device in which a two-component developer including a toner and a carrier is used.

Also, the stirring conveyance member of the present disclosure is applicable not only to the developing devices 2*a* to 2*d* each including the developer replenishment port 22*g* and the developer discharge port 22*h* as illustrated in FIG. 3, the magnetic roller 21, and the development roller 20. The stirring conveyance member of the present disclosure is applicable to various developing devices in which the two-component developer including the toner and the carrier is used.

Also, the present disclosure is applicable not only to the stirring conveyance member of the developing device, but also to a stirring conveyance member that conveys a powder other than the developer while stirring the powder.

Also, the present disclosure is not limited to the above-described embodiments where the configuration of the first spiral blade 43*a* and the second spiral blade 43*c* illustrated in FIGS. 4 to 7 is applied to both the first spiral 43 located within the first conveyance chamber 22*c* and the second spiral 44 located within the second conveyance chamber 22*d*. Depending on the specification of the developer, the present disclosure may be applied only to the second spiral 44 located within the second conveyance chamber 22*d* in order to increase the stirring effect only in the second conveyance chamber 22*d*. Alternatively, the present disclosure may be applied only to the first spiral 43 located within the first conveyance chamber 22*c* in order to increase the stirring effect only in the first conveyance chamber 22*c*. Note that in order to prevent formation of a non-uniform image by supplying the developer in the second conveyance chamber 22*d* in a uniform state to the magnetic roller 21, the developer conveyed to the second conveyance chamber 22*d* is preferably made uniform. Therefore, it is preferable to apply the configuration of the present disclosure at least to the first spiral 43 located within the first conveyance chamber 22*c*.

Also, the present disclosure is not limited to the above-described embodiments where the first spiral blade 43*a* and the second spiral blade 43*c* have the same pitch. The pitch of the first spiral blade 43*a* and the pitch of the second spiral blade 43*c* may be different from each other.

Further, although the first cutout 50 and the second cutout 51 are alternately formed for the intersection points 47 (at every 180°) in the above-described embodiments, the first cutout 50 and the second cutout 51 may be formed for the same intersection point 47. That is, both the first cutout 50 and the second cutout 51 may be foil led for the same every second intersection point 47.

Also, the present disclosure is not limited to the above-described first and second embodiments where only one first cutout 50 is formed in each turn of the first spiral blade 43*a* around the rotary shaft 43*b*. Two or more first cutouts 50 may be formed in each turn of the first spiral blade 43*a* around the rotary shaft 43*b*. Also, the first cutouts 50 may be formed for all of the intersection points 47. In this case, the developer stirring performance can be further improved.

Similarly, the present disclosure is not limited to the above-described first and third embodiments where only one second cutout 51 is formed in each turn of the second spiral blade 43*c* around the rotary shaft 43*b*. Two or more second cutouts 51 may be formed in each turn of the second spiral blade 43*c* around the rotary shaft 43*b*. Also, the second cutouts 51 may be formed for all the intersection points 47. In this case, the developer stirring performance can be further improved.

What is claimed is:

1. A stirring conveyance member comprising:

a rotary shaft supported to be rotatable within a powder container;

a first spiral blade provided on an outer circumferential surface of the rotary shaft and configured to convey a powder in an axial direction through rotation of the rotary shaft; and a second spiral blade provided on the outer circumferential surface of the rotary shaft such that, in the axial direction, a region in which the first spiral blade is provided overlaps with a region in which the second spiral blade is provided, the second spiral blade being in a phase opposite to the first spiral blade, and having a lower radial height than the first spiral blade, wherein the first spiral blade intersects the second spiral blade at at least one point in each turn around the rotary shaft, the first spiral blade has first cutouts each provided in a specific region adjacent to and upstream of a point of intersection with the second spiral blade in the conveyance direction of the powder by the first spiral blade, the second spiral blade has second cutouts each provided in a specific region adjacent to and upstream of a point of intersection with the first spiral blade in a conveyance direction of the powder by the second spiral blade, and a radial height of the first spiral blade in portions where the first cutouts are provided is lower than a radial height of the second spiral blade in portions where the second cutouts are not provided.

2. The stirring conveyance member according to claim 1, wherein each of the first cutouts has, in a circumferential direction of the rotary shaft, a dimension of an arc having a central angle of at least 60° and no greater than 120°.

3. The stirring conveyance member according to claim 1, wherein each of the second cutouts has, in a circumferential direction of the rotary shaft, a dimension of an arc having a central angle of at least 60° and smaller than 180°.

4. The stirring conveyance member according to claim 1, wherein the first cutouts and the second cutouts are provided such that in the axial direction, regions in which the first cutouts are provided do not overlap with regions in which the second cutouts are provided.

5. The stirring conveyance member according to claim 1, wherein the first spiral blade and the second spiral blade intersect each other at two points spaced apart from each other by 180° in each turn around the rotary shaft.

6. The stirring conveyance member according to claim 5, wherein the first cutouts and the second cutouts are alternately provided for the points of intersection located at every 180°.

7. The stirring conveyance member according to claim 1, wherein only one of the first cutouts is provided in each turn of the first spiral blade around the rotary shaft.

8. The stirring conveyance member according to claim 1, wherein only one of the second cutouts is provided in each turn of the second spiral blade around the rotary shaft.

9. The stirring conveyance member according to claim 1, wherein the radial height of the first spiral blade in the portions where the first cutouts are provided is zero.

10. The stirring conveyance member according to claim 1, wherein a radial height of the second spiral blade in portions where the second cutouts are provided is zero.

11. A developing device comprising:

a developer container configured to accommodate a two-component developer including a carrier and a toner;

a developer bearing member located within the developer container and configured to bear a developer within the developer container; and the stirring conveyance member according to claim 1 configured to convey the developer within the developer container while stirring the developer.

12. The developing device according to claim 11, wherein the developer container includes:

a first conveyance chamber and a second conveyance chamber arranged side by side;

communication areas that are located at respective opposite ends of the first conveyance chamber and the second conveyance chamber in lengthwise directions thereof and via which the first conveyance chamber and the second conveyance chamber communicate with each other; and a toner replenishment port via which a toner is replenished to the first conveyance chamber, the developer bearing member is arranged such that the developer in the second conveyance chamber is borne on a surface of the developer bearing member, a first stirring conveyance member and a second stirring conveyance member are provided within the developer container, the first stirring conveyance member being configured to convey the developer within the first conveyance chamber in an axial direction while stirring the developer, the second stirring conveyance member being configured to convey the developer within the second conveyance chamber in a direction opposite to the direction of conveyance of the developer by the first stirring conveyance member while stirring the developer, and the first stirring conveyance member is the stirring conveyance member according to claim 1.

13. The developing device according to claim 12, wherein the second stirring conveyance member is the stirring conveyance member according to claim 1.

14. An image forming apparatus in which the developing device according to claim 11 is installed.

15. A stirring conveyance member comprising:

a rotary shaft supported to be rotatable within a powder container;

a first spiral blade provided on an outer circumferential surface of the rotary shaft and configured to convey a powder in an axial direction through rotation of the rotary shaft; and a second spiral blade provided on the outer circumferential surface of the rotary shaft such that, in the axial direction, a region in which the first spiral blade is provided overlaps with a region in which the second spiral blade is provided, the second spiral blade being in a phase opposite to the first spiral blade, and having a lower radial height than the first spiral blade, wherein the first spiral blade intersects the second spiral blade at at least one point in each turn around the rotary shaft, the first spiral blade has cutouts each formed in a specific region adjacent to and upstream of a point of intersection with the second spiral blade in the conveyance direction of the powder by the first spiral blade, and a radial height of the first spiral blade in portions where the cutouts are provided is lower than a radial height of the second spiral blade.

16. The stirring conveyance member according to claim 15, wherein each of the cutouts has, in a circumferential direction of the rotary shaft, a dimension of an arc having a central angle of at least 60° and no greater than 120°.

17. The stirring conveyance member according to claim 15, wherein the first spiral blade and the second spiral blade intersect each other at two points spaced apart from each other by 180° in each turn around the rotary shaft.

18. A stirring conveyance member comprising:

a rotary shaft supported to be rotatable within a powder container;

a first spiral blade provided on an outer circumferential surface of the rotary shaft and configured to convey a powder in an axial direction through rotation of the rotary shaft; and a second spiral blade provided on the outer circumferential surface of the rotary shaft such that, in the axial direction, a region in which the first spiral blade is provided overlaps with a region in which the second spiral blade is provided, the second spiral blade being in a phase opposite to the first spiral blade, and having a lower radial height than the first spiral blade, wherein the first spiral blade intersects the second spiral blade at at least one point in each turn around the rotary shaft, and the second spiral blade has cutouts each formed in a specific region adjacent to and upstream of a point of intersection with the first spiral blade in a conveyance direction of the powder by the second spiral blade.

19. The stirring conveyance member according to claim 18, wherein each of the cutouts has, in a circumferential direction of the rotary shaft, a dimension of an arc having a central angle of at least 60° and smaller than 180°.

20. The stirring conveyance member according to claim 18, wherein the first spiral blade and the second spiral blade intersect each other at two points spaced apart from each other by 180° in each turn around the rotary shaft.

* * * * *